US007174687B2

(12) United States Patent
Ferguson

(10) Patent No.: US 7,174,687 B2
(45) Date of Patent: Feb. 13, 2007

(54) WEB OFFSET LUG DRY-STACK SYSTEM

(75) Inventor: Alan C. Ferguson, Dacula, GA (US)

(73) Assignee: FSN Research LLC, Manchester, NH (US)

( * ) Notice: Subject to any disclaimer, the term of this patent is extended or adjusted under 35 U.S.C. 154(b) by 0 days.

(21) Appl. No.: 11/255,565

(22) Filed: Oct. 21, 2005

(65) Prior Publication Data

US 2006/0037272 A1 Feb. 23, 2006

Related U.S. Application Data

(63) Continuation of application No. 11/007,968, filed on Dec. 9, 2004.

(60) Provisional application No. 60/529,457, filed on Dec. 12, 2003.

(51) Int. Cl.
*E04B 2/18* (2006.01)
*E04C 1/00* (2006.01)

(52) U.S. Cl. ..... 52/592.6; 52/100; 52/561; 52/604; D25/114

(58) Field of Classification Search ..... 52/592.6, 52/603, 604, 606, 561, 100, 592.5, 286; D25/115; 405/286
See application file for complete search history.

(56) References Cited

U.S. PATENT DOCUMENTS 2,684,589 A * 7/1954 Perreton ..... 52/591.2
2,703,487 A * 3/1955 Ossoinack ..... 52/592.3
3,888,060 A * 6/1975 Haener ..... 52/284
3,968,615 A 7/1976 Ivany
4,107,894 A * 8/1978 Mullins ..... 52/592.6
4,182,089 A 1/1980 Cook
4,186,540 A * 2/1980 Mullins ..... 52/592.6

(Continued)

FOREIGN PATENT DOCUMENTS

CA 1154278 9/1983

(Continued)

OTHER PUBLICATIONS

National Concrete and Masonry Institute, "Design and Construction of Dry-Stack Walls", Publication TEK 14-22, 6 pages (C) 2003.*

(Continued)

*Primary Examiner*—Robert Canfield
(74) *Attorney, Agent, or Firm*—Bourque and Associates

(57) ABSTRACT

Generally, the invention is a dry stack building block for constructing a masonry wall. The dry stack unit has a front section having an outer surface, an inner surface, a bottom surface, and a top surface. The dry stack unit also has a rear section substantially parallel to the front section having an outer surface, an inner surface, a bottom surface, and a top surface. Two or more webs coupling the inner surface of the front section to the inner surface of the rear section have a top surface and a bottom surface. Two or more pairs of lugs may extend above the top surface of the front section and the top surface of the rear section. Each pair of lugs may have a first lug offset from a second lug in an axis perpendicular to the inner surfaces of the front section and the back section.

20 Claims, 9 Drawing Sheets

U.S. PATENT DOCUMENTS

| | | | | | |
|---|---|---|---|---|---|
| 4,640,071 | A | | 2/1987 | Haener | |
| 4,982,544 | A | * | 1/1991 | Smith | 52/606 |
| 5,014,480 | A | * | 5/1991 | Guarriello et al. | 52/309.12 |
| 5,123,222 | A | * | 6/1992 | Guarriello et al. | 52/309.12 |
| 5,575,128 | A | | 11/1996 | Haener | |
| 5,699,640 | A | * | 12/1997 | Bourgeois et al. | 52/309.4 |
| 5,822,939 | A | * | 10/1998 | Haener | 52/405.2 |
| 5,894,702 | A | | 4/1999 | Stenekes | |
| 5,901,520 | A | * | 5/1999 | Abdul-Baki | 52/592.6 |
| 5,992,102 | A | * | 11/1999 | Ozawa | 52/100 |
| 6,050,749 | A | | 4/2000 | Khamis | |
| 6,065,265 | A | | 5/2000 | Stenekes | |
| 6,089,792 | A | | 7/2000 | Khamis | |
| 6,122,880 | A | | 9/2000 | Kolb et al. | |
| 6,134,853 | A | * | 10/2000 | Haener | 52/405.2 |
| 6,907,704 | B2 | | 6/2005 | Abang Ali et al. | |
| 2002/0007610 | A1 | | 1/2002 | Ali et al. | |
| 2005/0204663 | A1 | | 9/2005 | Ferguson | |
| 2006/0150559 | A1 | * | 7/2006 | Haener | 52/606 |

FOREIGN PATENT DOCUMENTS

| | | | |
|---|---|---|---|
| GB | 561654 A | * | 5/1944 |
| WO | 96/00331 | * | 1/1996 |
| WO | 00/24982 | * | 5/2000 |

OTHER PUBLICATIONS

URL: ftp://imgs.ebuild.com/woc/M99B020.pdf, Motarless Block Systems, Author: Pieter VanderWerf. 4 pages no date.

* cited by examiner

100

PRIOR ART

100

PRIOR ART

900

WEB OFFSET LUG DRY-STACK SYSTEM

CROSS-REFERENCE TO RELATED APPLICATIONS

The present application is a continuation application of U.S. application Ser. No. 11/007,968 filed Dec. 9, 2004 which claims priority from U.S. provisional patent application, Ser. No. 60/529,457, filed Dec. 12, 2003, by Alan Corbett Ferguson, incorporated by reference herein and for which benefit of the priority date is hereby claimed.

TECHNICAL FIELD

The present invention relates to dry-stack concrete masonry systems for building structural load bearing and non-load bearing walls and, more particularly, two distinct concrete masonry units with a web offset lug design that provides for both stack bonding and running bond construction with unobstructed vertical cell alignment to facilitate both solid and partial concrete grouting (for structural strength) with and without steel reinforcement.

BACKGROUND INFORMATION

An advantage of dry stack masonry systems is that the labor component of installation can be dramatically reduced. Some studies have shown that dry stack masonry systems are up to ten times faster to install than conventional joint mortared masonry systems. Because these systems do not use bonding mortar to provide joint support, it may be necessary to use other means of developing wall strength.

One technique to develop wall strength is to pour wet concrete or grout into the openings of the block to form vertical posts. The wet concrete is poured into the open cells of the concrete block. Various building codes may require dry-stacked concrete block cells to be filled differently in order to provide specified structural integrity. Some applications may require all the cells to be filled with concrete. Other applications may require the concrete to be poured into distinct vertical columns and only in certain cells or cores of the block. These applications may require cells, for example, to be filled generally at four foot on center increments and/or at wall corners and jambs of windows and doors or various load points. A general overview of the use of current dry stack methods in masonry wall construction can be found in National Concrete Masonry Association's (NCMA) technical publication TEK 14–22 "Design and Construction of Dry-Stack Masonry Walls."

The vertical posts are typically reinforced with reinforcement members, for example, steel rebar. The problem with many dry stack block systems is that when stacked, the cells or core holes of the block are not completely aligned. The cells between successive layers of block may vary in size as shown in FIGS. 1A and 1B. FIGS. 1A and 1B show a stack of a conventional dry block system 100. The middle row 102 provides a narrow passage 104 relative to the top row 106 and bottom row 108. When concrete is poured in the cells the variation in cell dimensions may hinder or prevent reinforcement members from being inserted in the cores to form the vertical posts. In addition, the variation in cell dimensions may make it difficult to fill the voids within the cell. Many conventional dry stack block systems may provide little or no damming capacity when filling the cells of a dry stack block wall structure.

The current dry stack wall systems used in building construction for load bearing and non-load bearing walls that incorporate raised lugs for alignment and interlocking do not provide adequate or uniform core orientation, as previously discussed. Additional descriptions of prior art raised lug systems are disclosed in U.S. Pat. No. 3,968,615 to Ivany, U.S. Pat. No. 4,182,089 to Cook, and U.S. Pat. No. 4,640,071 to Haener.

When stacked in a running bond, a core block resting on top of two halves of a lower adjacent block, the lack of uniform orientation of prior art systems fail to provide a uniform and well-aligned core for forming concrete posts. The prior art dry-stack block systems require lugs that project above the top surface of the block. These lugs tend to limit where blocks can be stacked in relation to one another. In addition, the prior art alignment of lugs prevents the stacking of blocks in a single stack bonded configuration (one block resting completely on top of a lower adjacent block).

SUMMARY

In one aspect the invention features a dry stack building block for constructing a masonry wall. The block may have a front section having an outer surface, an inner surface, a bottom surface, and a top surface. The block may also have a rear section substantially parallel to the front section having an outer surface, an inner surface, a bottom surface, and a top surface. Two or more webs may couple the inner surface of the front section to the inner surface of the rear section and having a top surface and a bottom surface. Two or more pairs of lugs may extend above the top surface of the front section and the top surface of the rear section. Each pair of lugs may have a first lug offset from a second lug in an axis running parallel to the top surfaces of the front section and the back section and perpendicular to the inner surfaces of the front section and the back section.

Embodiments may include one or more of the following. One pair of the two or more pairs of lugs may be positioned to receive a second duplicate dry stack block staged halfway off-center and a second pair of the two or more lugs may be positioned to receive a third duplicate dry stack block staged halfway off-center in a direction opposite and adjacent to the second stack block. The top surfaces of the front section and rear section may be adapted to receive a bottom surface of a front section and a bottom surface of a rear section of another duplicate dry stack building block. The outer surface of the front section and the outer surface of the rear section may have a chamfered edge. A first lug of each pair of the two or more pairs of lugs may have a chamfered edge adjacent to the front section and the second lug of each pair of the two or more pairs has a beveled edge adjacent to the rear section. The two or more webs may be substantially perpendicular to the front section and the rear section. Each of the two or more webs may have one lug of a pair of the two or more pairs of lugs adjacent to the inner surface of the front section and a first side surface of the web and a second lug of the pair adjacent to the inner surface of the rear section and a second side surface opposite the first side surface of the web. A first angle produced by a first web of the two or more webs and the front section plus a second angle produced by a second web of the two or more webs and the front section may be substantially equal to 180 degrees. Each of the two or more webs may have one lug of a pair of the two or more pairs of lugs extending from the top surface of the web and adjacent to the front section and a second lug of the pair extending from the top surface of the web and adjacent to the rear section. The two or more webs may have a knock-out portion for providing a bond beam.

In another aspect the invention may feature a corner block for constructing a corner wall portion. The corner block may have a front section having an outer surface, an inner surface, a bottom surface, and a top surface. The corner block may also have a rear section substantially parallel to the front section having an outer surface, an inner surface, a bottom surface, and a top surface. A side section may be coupled and substantially perpendicular to the front section and the back section. The side section may have an outer surface contacting the outer surfaces of the front section and rear section, a bottom surface, and a top surface. The corner block may have one or more webs coupling the inner surface of the front section to the inner surface of the rear section and spaced to receive the one or more pairs of lugs.

Embodiments of the invention may have one or more of the following advantages. The invention may provide an improved dry-stack concrete masonry block for constructing masonry load, bearing and non-load bearing wall assemblies. The invention may allow for improved core alignment from the bottom to the top of wall construction. The invention may also make partial filling of dry-stack block cells faster, easier, and stronger. The invention may also make structural reinforcement of wall assembly easier and faster in conjunction with concrete or without concrete (i.e. post tensioned). The invention may also allow the installer to construct in both running bonded and stack bonded orientations.

BRIEF DESCRIPTION OF THE DRAWINGS

These and other features and advantages of the present invention will be better understood by reading the following detailed description, taken together with the drawings wherein.

For purposes of clarity and brevity, like elements and components will bear the same designations and numbering throughout the FIGURES.

DETAILED DESCRIPTION

Figure 1A:
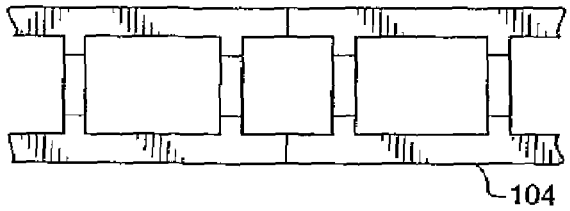
FIG. 1A is a top plane view and FIG. 1B is a front cross sectional side view of a prior art conventional dry stack block assembled into a linear wall structure.
Figure 1B:
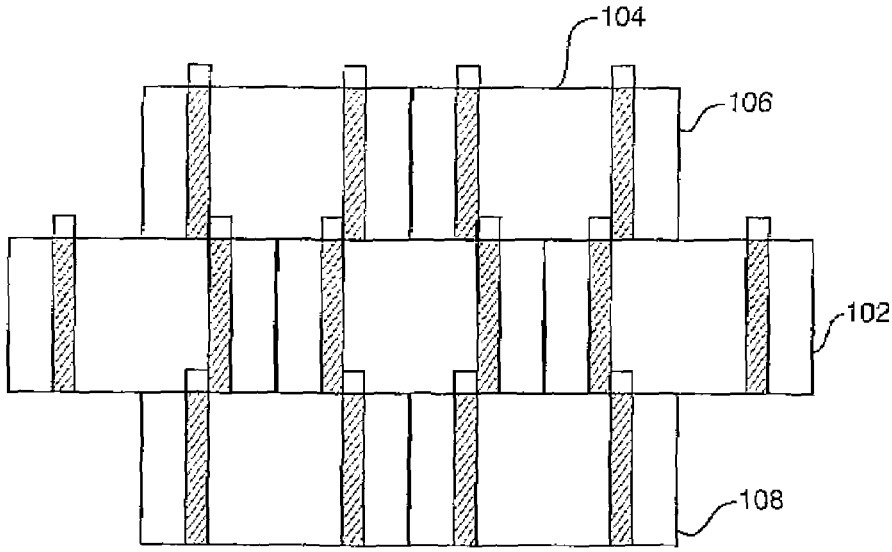
Figure 2:
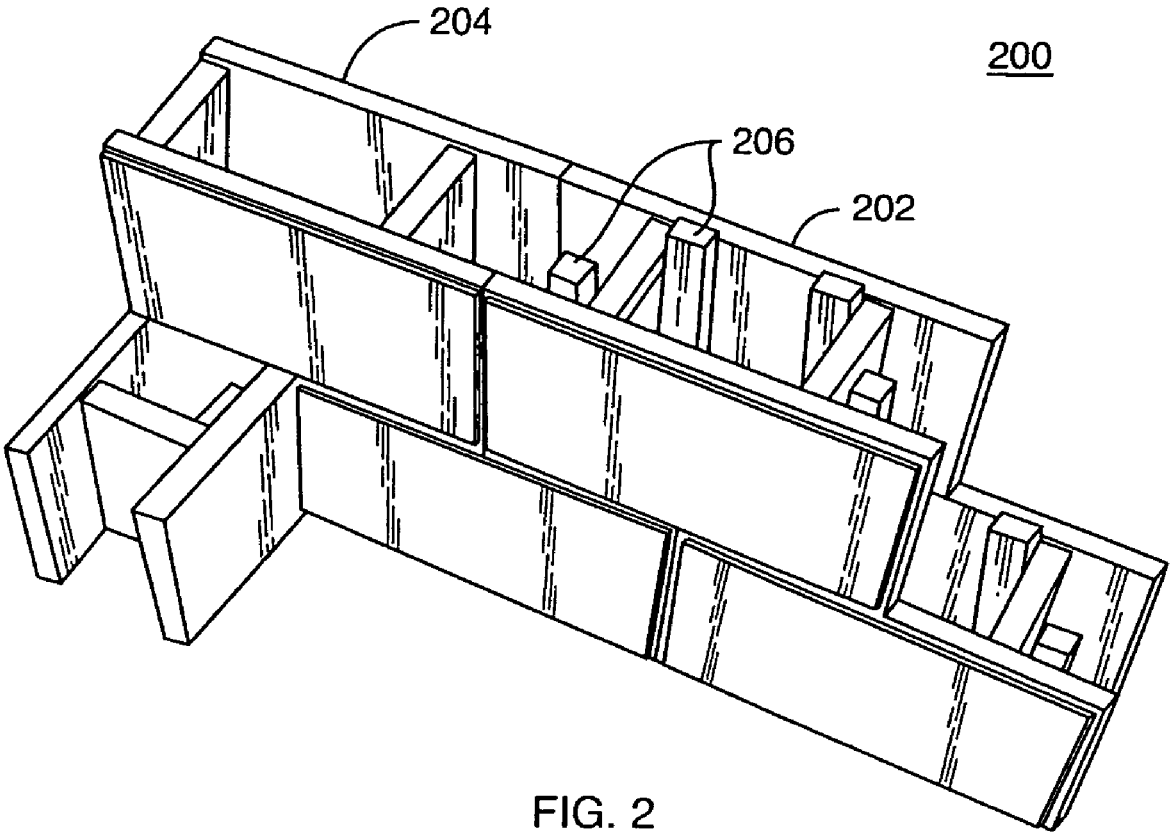
FIG. 2 is a perspective view of the present invention comprising two dry-stack units, a stretcher unit and a corner unit shown here assembled into a wall structure turning a 90 degree corner.

A corner wall structure 200 may use a stretcher unit 202 and a corner unit 204 to construct the corner and straight portions of a wall, as shown in FIG. 2. The stretcher units 202 have lugs 206 that extend above the top of the stretcher unit 202. The next course of stretcher units is placed on top of the previous layer of stretcher units. The lugs 206 of the previous layer of stretcher units extend into the cells of the next course of stretcher units. The lugs provide face shell alignment, lateral strength, and lock together successive layers of units.

The stretcher units 202 have a front section and a rear section. One or more webs or ribs couple the front section to the rear section. The one or more webs may extend just below the top surface of the stretcher unit 202 or may extend all the way to the top surface of the stretcher unit 202. The stretcher units 202 also have lugs that extend above the top surface of the stretcher unit 202. The stretcher unit 202 and other exemplary embodiments of the stretcher unit 202 will be described in greater detail later herein. The corner units 204 may also have a front section, rear section, and one or more webs coupling the front section and rear section. The corner unit also has a side section. The side section provides a ninety-degree corner in the wall. The corner unit 204 provides a uniform surface at the corner of the wall. The corner units 204 are staggered with each successive row. The corner unit 204 and other exemplary embodiments of the stretcher unit 202 will be described in greater detail later herein.

Figure 3:
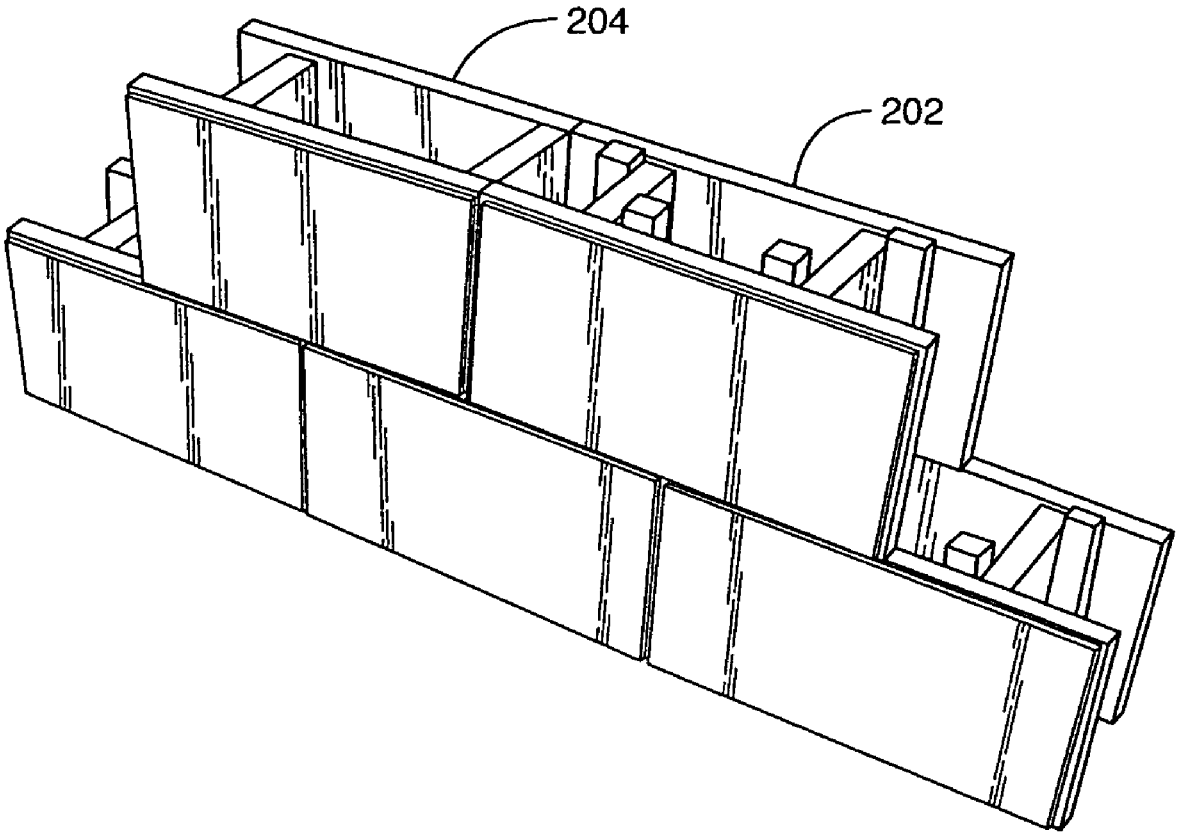
FIG. 3 is a perspective view of present invention comprising the two dry-stack units, the stretcher unit and the corner unit shown here assembled into a linear wall structure.

The corner unit 204 may not have lugs extending from the top. The corner unit may be used in a straight wall portion, as shown in FIG. 3. The spacing and alignment of lugs, as will be discussed later herein, allows the corner section to be placed within a straight portion of the wall. The lugs of the lower stretcher units 202 extend into the cells of the corner unit 204 without interfering with the side section or the webs of the corner unit.

Figure 4A:
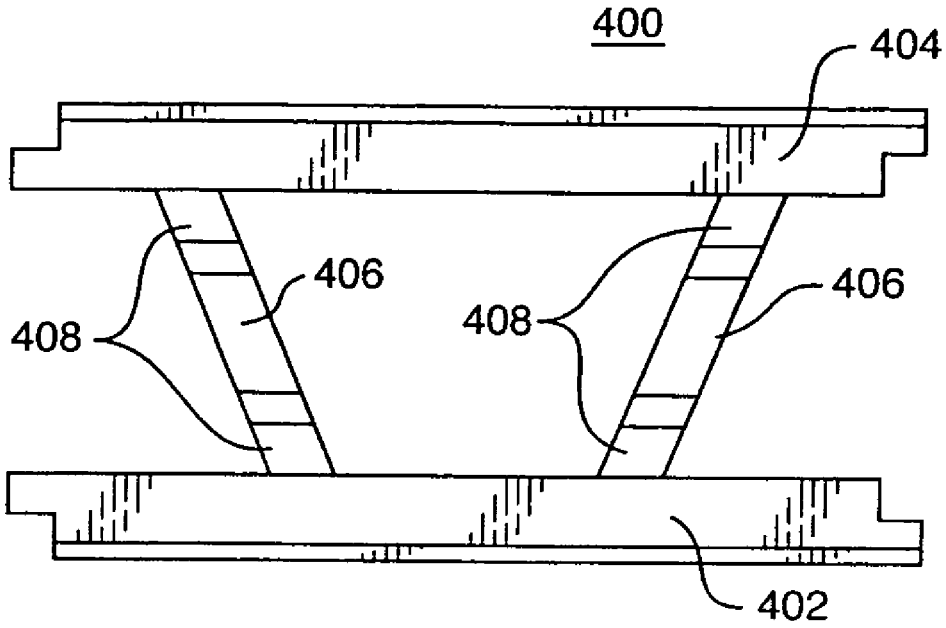
FIG. 4A is a top plane view and FIG. 4B is a side profile view of the stretcher unit according to an exemplary embodiment of the invention with webs at non-right angles.
Figure 4B:
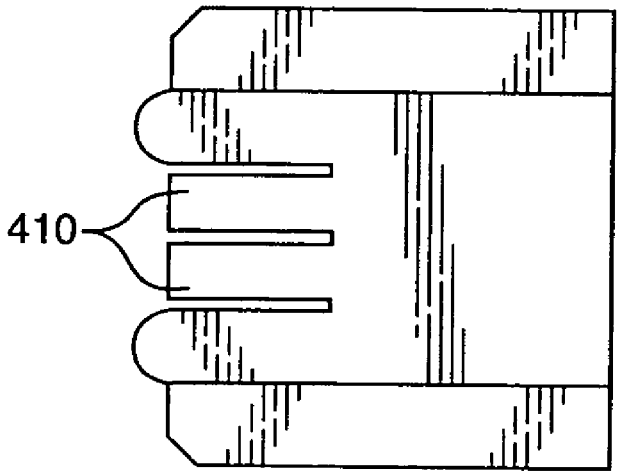

FIG. 4A is a top plane view and FIG. 4B is a side profile view of a stretcher unit 400 according to an exemplary embodiment of the invention with webs at non-right angles. The stretcher unit 400 may have a height of eight inches and a length of sixteen inches. The stretcher unit 400 has a front section 402 and a rear section 404. The front section 402 and the rear section 404 may have a thickness of one and quarter (+/−) inches. One or more webs 406 couple the front section 402 to the rear section 404. The webs 406 may have a thickness of one and a half inches (+/−). The webs 406, according to this embodiment, are symmetrically angled between the front section 402 and the rear section 404. Each web 406 has a pair of lugs 408 extending from the top surface of the web. The lugs 408 may extend above the top surface by $3/8^{th}$ (+/−) of an inch. The lugs may have a width and thickness of one inch (+/−). The angled webs 406 allow the stretcher units to be stacked in a staggered fashion without the lugs interfering with the web of a successive layer of stretcher units. The web of the successive layer of stretcher units straddles each pair of lugs 408. The stretcher unit is supported in the lateral direction by a lug positioned between the inner surface of the front or rear section and the web.

The exemplary embodiments shown in FIGS. 4A and 4B may also include round lugs. The lugs have a round top portion, which aids in the stacking of successive stretcher units. The weight of successive stretcher units pushing down centers the unit into the correct resting position. The rounded lugs help to prevent successive stretcher units becoming stuck or partially resting on the lug of lower stretcher units. The exemplary embodiments shown in FIG. 4B may also include a knock-out portion 410 for producing a bonding-beam portion in the constructed wall. The knock-out portion 410 may extend down three inches (+/−) from the top surface. The knock-out portion 410 may have a three quarter inch slot to allow for placing reinforcement members or removing the knock-out portion 410. Bonding-beams are horizontal reinforcements in the wall that add strength between the vertical columns of the constructed wall. A row of stretcher units in a wall of individual or successive rows may be designated for a bonding-beam. During construction the knock-out portion 410 may be removed to allow reinforcement members and/or poured concrete to fill the cells of a row of stretcher units. The knock-out portion 410 may be molded into the stretcher unit between the lugs 408 of the web 406.

The exemplary embodiments shown in FIGS. 4A and 4B may also include chamfered edges on the sides for the front section and the rear section. The chamfer allows the adjacent stretcher unit to fit snuggly against the neighboring stretcher unit. The chamfers of neighboring stretcher units overlap providing additional strength and preventing leaking of concrete from the cell columns during pouring. The chamfers may have a $3/8^{th}$ (+/−) inch inset. The exemplary embodiments shown in FIGS. 4A and 4B may also include beveled edges on the outer surface of the front section and the rear section. The beveled edges of the stretcher unit give the wall a more traditional block construction look. The beveled edge outlines the profile of the block without the need for grouted joints. The edge is not limited to a bevel. The edge may have a chamfer or other profile to outline the block face.

Figure 5A:
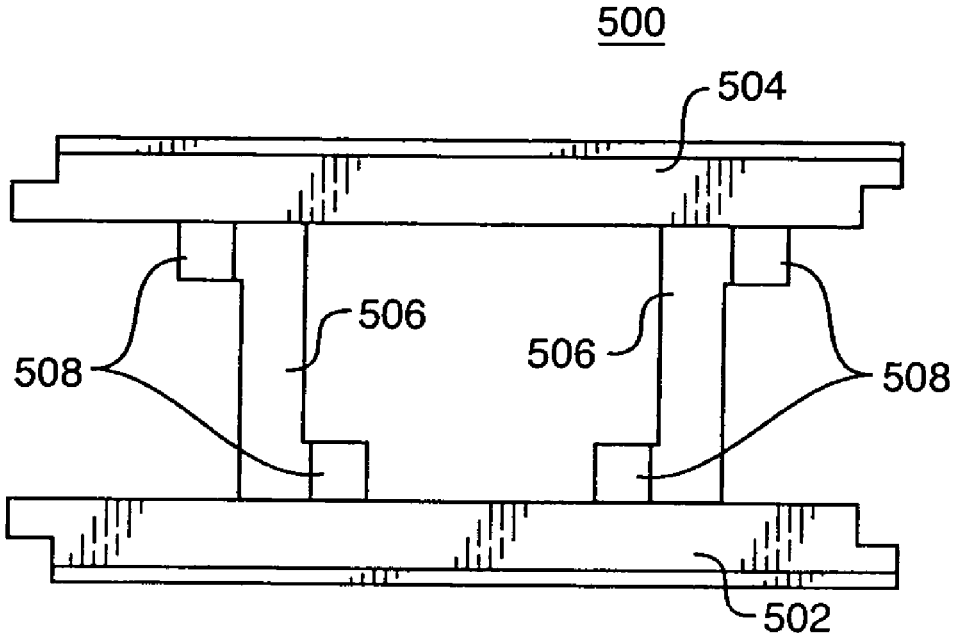
FIG. 5A is a top plane view and FIG. 5B is a side profile view of the stretcher unit according to an exemplary embodiment of the invention with webs at right angles.
Figure 5B:
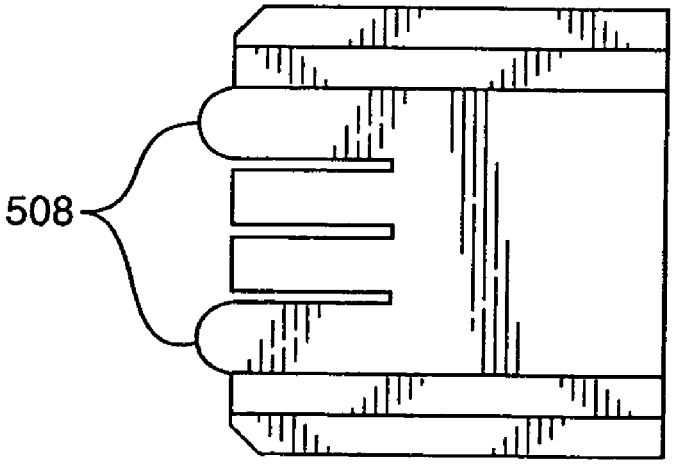
Figure 6A:
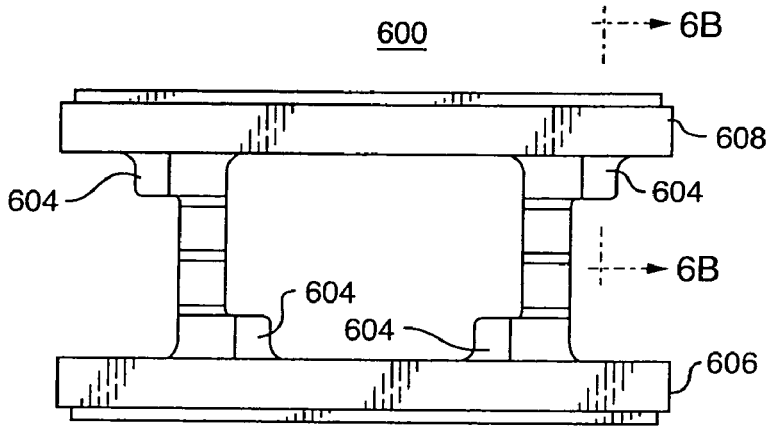
FIG. 6A is a top plane view.
Figure 6B:
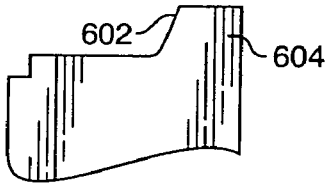
FIG. 6B is a cross sectional view.
Figure 6C:
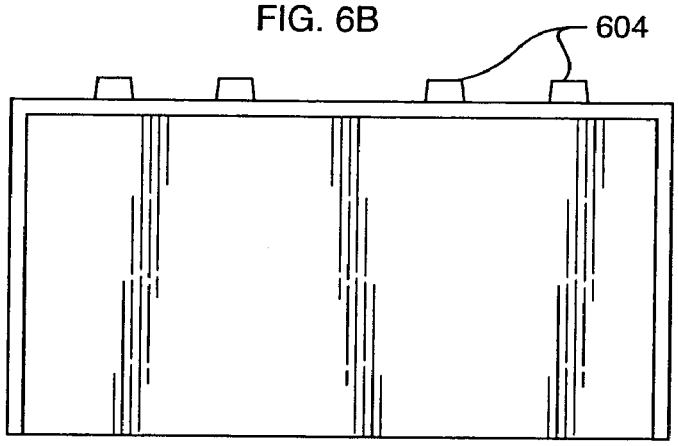
FIG. 6C is a front profile view.
Figure 6D:
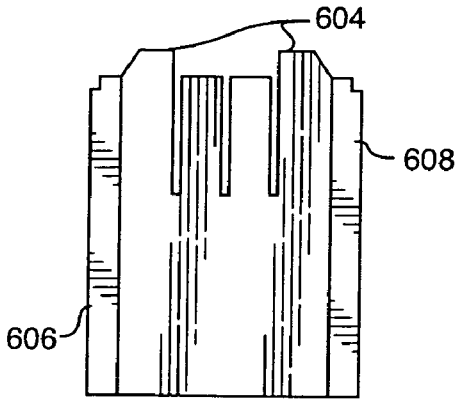
FIG. 6*d* is a side profile view of the stretcher unit according to an exemplary embodiment of the invention with beveled lug profiles.

An exemplary embodiment of the invention with webs at right angles is shown in FIG. 5A and FIG. 5B. The stretcher unit 500 has a front section 502 and a rear section 504. One or more webs 506 couple the front section 502 to the rear section 504. The webs 506, according to this embodiment, run perpendicular between the front section 502 and the rear section 504. The webs 506 may be spaced four inches (+/−) from the end of the stretcher unit 500. To provide cores that line up, each web 506 has a pair of alternating, adjacent lugs 508. The lugs 508 extend above the surface of the stretcher unit 500 and allow the stretcher units to be stacked in a staggered fashion without the lugs 508 interfering with the web of a successive layer of stretcher units.

A first lug of the pair of lugs is coupled against a first surface of a first web and an inner surface of the rear section. A second lug of the pair of lugs is coupled against a second surface of the first web and the inner surface of the front section. A second pair of lugs for the stretcher unit has a first lug of the second pair coupled against a first surface of a second web and an inner surface of the front section. A second lug of the second pair of lugs is coupled against a second surface of the second web and the inner surface of the rear section. Each of the lugs in the first pair of lugs is positioned on alternating sides of the first web. Each lug of the second pair of lugs is also positioned on alternating sides of the second web; however, the lugs are on opposite sides from the first web. This allows the successive layer of stretcher units to rest on the stretcher unit and allows the lugs 508 of the stretcher unit 500 to protrude into the cells of the successive layer of stretcher units without interfering with the lugs of the successive layer of stretcher units.

When the wall is constructed the stretcher units may be staged half way off-center for each successive row. This allows the alternating pairs of lugs to straddle the webs of successive rows of stretcher units. The stretcher unit 500 is supported in the lateral direction by a lug positioned between the inner surface of the front or rear section and the web. The constructed wall locks together by the protruding lugs extending into the cells and straddling the webs of successive rows of stretcher units above and below the stretcher unit.

The stretcher unit 500 may also have a beveled profile on the outer surface of the front section and rear section. The stretcher unit 500 may also have a chamfered side edge for coupling to adjacent units. In addition, the stretcher unit may have a knock-out portion for producing a bonding-beam. These features are similar to those previously described herein with respect to the exemplary embodiment disclosing the exemplary stretcher unit 400 with angled webs.

An exemplary embodiment of the invention with beveled lug profiles is shown in FIGS. 6A, 6B, 6C, and 6D. The exemplary embodiments 600 may include a beveled lug profile 602. The lugs 604 have a beveled surface adjacent to the outer surface of the front section 606 and the rear section 608. The beveled profile aids in the stacking of successive stretcher units. The weight of successive stretcher units pushing down centers the unit into the correct resting position. The beveled lug profiles 602 help to prevent successive stretcher units from becoming stuck or partially resting on the lug of lower stretcher units. In addition to a beveled profile on the surface of the lug facing the outer surface of the front section and the rear section, the lugs may also have a beveled surface adjacent to the web (not shown in Figures). The additional beveled profile aids in stacking and aligning the face shells of the stretcher unit as previously discussed.

Figure 7A:
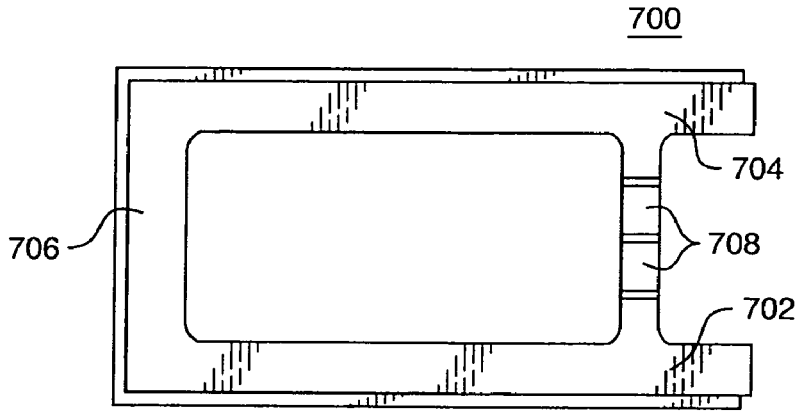
FIG. 7A is a top plane view.
Figure 7B:
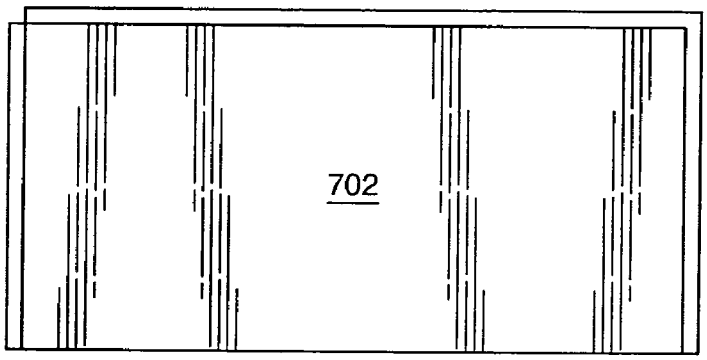
FIG. 7B is a front profile view.
Figure 7C:
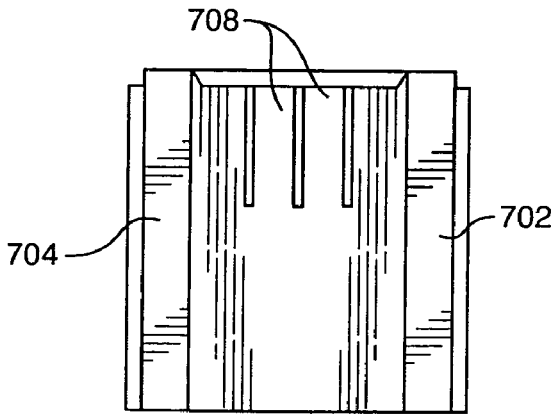
FIG. 7C is a side profile view of the corner unit according to an exemplary embodiment of the invention.

A corner unit 700 according to an exemplary embodiment of the invention is shown in FIGS. 7A, 7B, and 7C. The corner unit 700 has a front section 702 and a rear section 704. The corner unit 700 also has a side section 706 coupling the front section 702 and the rear section 704. One or more webs 708 couple the front section 702 to the rear section 704. The corner unit 700 may be positioned at the corner of a constructed wall as shown in FIG. 2. The side section 706 provides a uniform appearance at the end of a row of units and provides support for successive rows of units. The corner units may be stacked alternating by 90 degrees for each row. This provides a lacing of rows between two linear portions of the structure. The cell of the corner units 700 may be filled with concrete to lock the corner units 700 together.

The web 708 is spaced to receive lugs from a previous row of stretcher units off-set by half a unit length. The web is spaced within the corner unit so as to align on top of the web of a previous row of stretcher units allowing the lugs of the previous row of stretcher units to straddle the web. The corner unit may also be used in the construction of a linear position of a wall as shown in FIG. 3. The corner unit 700 may also have a beveled or chamfered profile on the outer surface of the front section 702 and rear section 704. The corner unit 700 may also have a chamfered side edge for coupling to adjacent units. In addition, the stretcher unit may have a knock-out portion for producing a bonding-beam. These features are similar to those previously described herein with respect to the exemplary embodiment disclosing the exemplary stretcher unit 400 with angled webs.

Figure 8A:
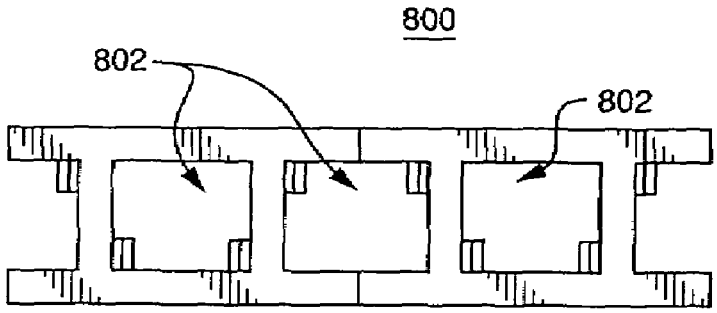
FIG. 8A is a top plane view and FIG. 8B is a front cross sectional side view of the stretcher unit assembled into a linear wall structure.
Figure 8B:
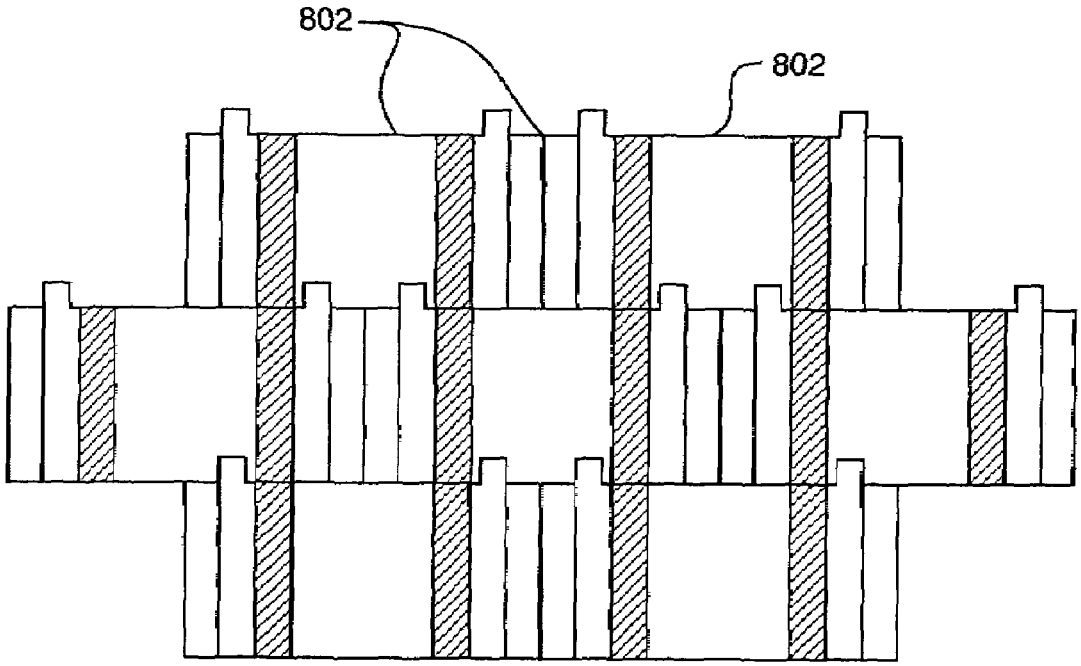

The stretcher units may assemble into a linear wall structure 800 as shown in FIGS. 8A and 8B. The linear cells 802 of the stretcher and/or corner units produce a vertical post. The vertical posts typically may be reinforced with a reinforcement member, for example, steel rebar. The linear cells 802 of the stacked stretcher units provide a more consistent size and are aligned linearly. When concrete is poured into the cells the more consistent size of the linear cell makes it less difficult to install reinforcement members in the cores to form the vertical posts. In addition, the more uniform cell dimensions may make it less difficult to fill the voids within the cell. Many conventional dry stack block systems may provide little or no damming capacity when filling the cells of a dry stack block wall structure.

Figure 9:
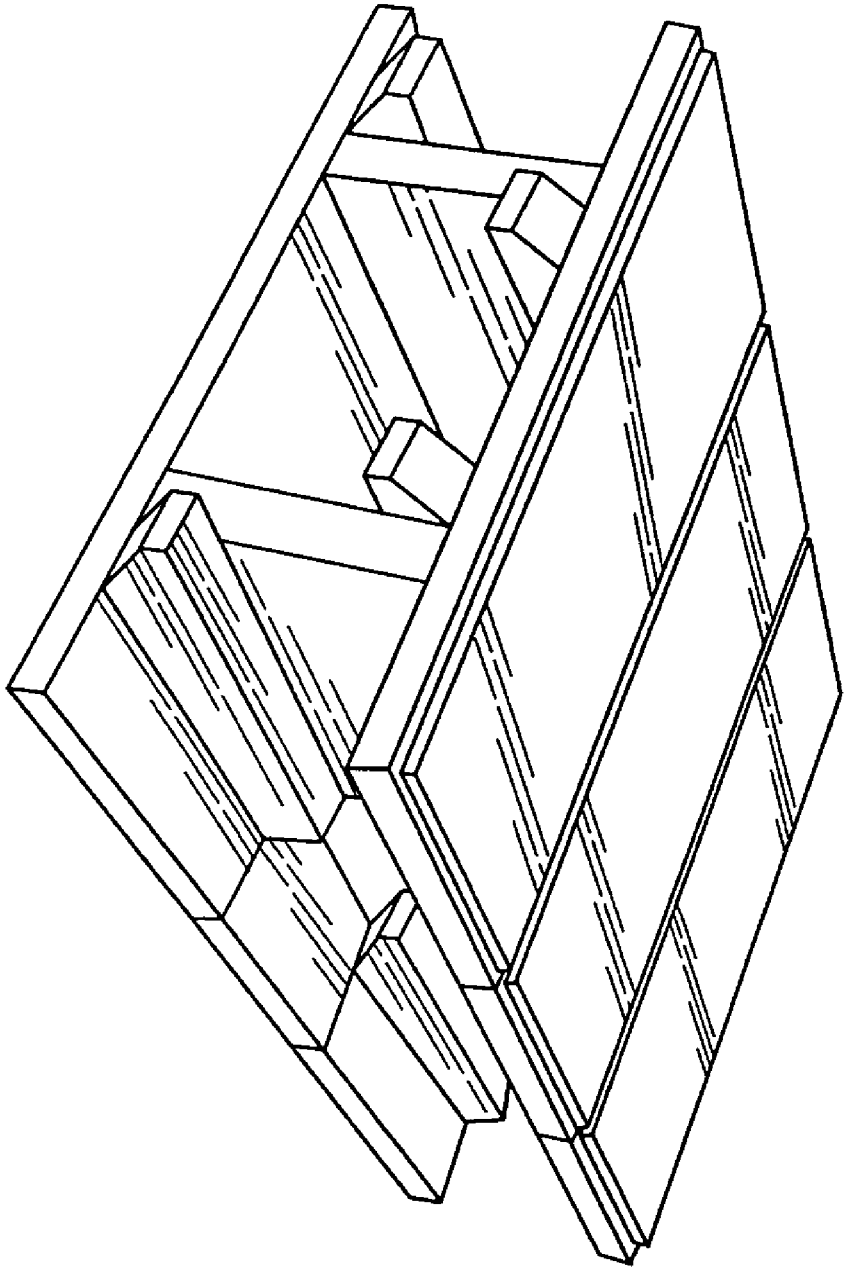
FIG. 9 is a perspective view of the stretcher units stacked according to an exemplary stack-bonding embodiment.

FIG. 9 is a perspective view of the stretcher unit stacked according to an exemplary stacking embodiment 900. The dimensions and structure of the stretcher unit provide the ability to stack a single column of units. By alternating each successive unit by 180 degrees the next stretcher unit may be stacked on top of a successive unit. The lugs of the stretcher units align in the cells of each successive stretcher unit.

Modifications may be made to fit particular operating requirements and environments as will be apparent to those skilled in the art, the invention is not considered limited to the examples chosen for purposes of disclosure, and covers all changes and modifications which do not constitute departures from the true spirit and scope of this invention. Modifications and substitutions by one of ordinary skill in the art are considered to be within the scope of the present invention.

The invention claimed is:

1. A dry stack building block for constructing a masonry wall comprising:

a front section having an outer surface, an inner surface, a bottom surface, and a top surface;

a rear section, substantially parallel to the front section and having an outer surface, an inner surface, a bottom surface, and a top surface;

two or more webs coupling the inner surface of the front section to the inner surface of the rear section, each of the two or more webs having a top surface and a bottom surface; and consisting essentially of a pair of lugs disposed proximate each of the two or more webs and extending above the top surface of the front section and the top surface of the rear section and wherein each pair of lugs has a first lug offset from a second lug, said offset disposed about an axis perpendicular to the inner surfaces of the front section and the back section.

2. The dry stack building block of claim 1, wherein one pair of the two or more pairs of lugs are positioned to receive a second duplicate dry stack block staged halfway off-center and a second pair of the two or more lugs are positioned to receive a third duplicate dry stack block staged halfway off-center in a direction opposite and adjacent to the second stack block.

3. The dry stack building block of claim 1, wherein the top surfaces of the front section and rear section are adapted to receive a bottom surface of a front section and a bottom surface of a rear section of another duplicate dry stack building block.

4. The dry stack building block of claim 1, wherein the outer surface of the front section and the outer surface of the rear section have a chamfered edge.

5. The dry stack building block of claim 1, wherein a first lug of each pair of the two or more pairs of lugs has a chamfered edge adjacent to the front section and the second lug of each pair of the two or more pairs has a beveled edge adjacent to the rear section.

6. The dry stack building block of claim 1, wherein the two or more webs are substantially perpendicular to the front section and the rear section.

7. The dry stack building block of claim 6, wherein the two or more webs has one lug of a first pair of the two or more pairs of lugs adjacent to the inner surface of the front section and a first side surface of a first web of the two or more webs and a second lug of the first pair adjacent to the inner surface of the rear section and a second side surface opposite the first side surface of the first web of the two or more webs and one lug of a second pair of the two or more pairs of lugs adjacent to the inner surface of the front section and a first side surface of a second web of the two or more webs and a second lug of the second pair adjacent to the inner surface of the rear section and a second side surface opposite the first side surface of the second web of the two or more webs.

8. The dry stack building block of claim 1, wherein the first angle produced by a first web of the two or more webs and the front section plus a second angle produced by a second web of the two or more webs and the front section is substantially equal to 180 degrees.

9. The dry stack building block of claim 8, wherein each of the two or more webs has one lug of a pair of the two or more pairs of lugs extending from the top surface of the web and adjacent to the front section and a second lug of the pair extending from the top surface of the web and adjacent to the rear section.

10. The dry stack building block of claim 1, wherein the two or more webs have a knock-out portion for providing a bond beam.

11. A dry stack building block system for constructing a masonry wall comprising a plurality of stretcher blocks, each stretcher block comprising:

a front section having an outer surface, an inner surface, a bottom surface, and a top surface;

a rear section substantially parallel to the front section having an outer surface, an inner surface, a bottom surface, and a top surface;

two or more webs coupling the inner surface of the front section to the inner surface of the rear section; and consisting essentially of a pair of lugs disposed proximate each of the two or more webs and extending above the top surface of the front section and the top surface of the rear section and wherein each pair of lugs has a first lug offset from a second lug, said offset disposed about an axis perpendicular to the inner surfaces of the front section and the back section.

12. The dry stack building block system of claim 11, wherein one pair of the two or more pairs of lugs are positioned to receive one of a second duplicate stretcher block and a third duplicate stretcher block staged halfway off-center.

13. The dry stack building block system of claim 11, wherein the top surfaces of the front section and rear section are adapted to receive a bottom surface of a front section and a bottom surface of a rear section of one of a duplicate stretcher block.

14. The dry stack building block system of claim 11, wherein the outer surface of the front section and the outer surface of the rear section of the stretcher block have a chamfered edge.

15. The dry stack building block system of claim 11, wherein a first lug of each pair of the two or more pairs of lugs has a chamfered edge adjacent to the front section and the second lug of each pair of the two or more pairs has a beveled edge adjacent to the rear section.

16. The dry stack building block system of claim 11, wherein the two or more webs of the stretcher block are substantially perpendicular to the front section and the rear section of the stretcher block.

17. The dry stack building block system of claim 16, wherein each of the two or more webs of the stretcher block has one lug of a pair of the two or more pairs of lugs adjacent to the inner surface of the front section and a first side surface of the web and a second lug of the pair adjacent to the inner surface of the rear section and a second side surface opposite the first side surface of the web.

18. The dry stack building block system of claim 11, wherein the first angle produced by a first web of the two or more webs and the front section of the stretcher block plus a second angle produced by a second web of the two or more webs and the front section of the stretcher block substantially equal to 180 degrees.

19. The dry stack building block system of claim 18, wherein each of the two or more webs of the stretcher block has one lug of a pair of the two or more pairs of lugs extending from the top surface of the web and adjacent to the front section and a second lug of the pair extending from the top surface of the web and adjacent to the rear section.

20. A dry stack building block for constructing a masonry wall without mortar joints comprising:

a front section having an outer surface, an inner surface, a bottom surface, and a top surface;

a rear section substantially parallel to the front section having an outer surface, an inner surface, a bottom surface, and a top surface;

means for coupling the inner surface of the front section to the inner surface of the rear section and having a top surface and a bottom surface wherein the means for coupling are aligned on top of each other as successive rows of block are stacked; and means for providing alignment of stacked blocks wherein the means for providing alignment, consisting essentially of a pair of protrusions for each means of coupling extending above the top surface of the front section and the top surface of the rear section, each pair of protrusions for each means of coupling has a first protrusion offset from a second protrusion in an axis running perpendicular to the inner surfaces of the front section and the back section, and enter within a cell produced by a front section, a rear section and a means for coupling of a successive row of staged stacked blocks.

* * * * *